United States Patent [19]

vander Griendt et al.

[11] 4,337,719

[45] Jul. 6, 1982

[54] MANDREL SUPPORT MEANS FOR CONTAINER DECORATING APPARATUS

[75] Inventors: Pieter S. vander Griendt, Bernardsville, N.J.; Robert W. Tielrooy, Amstelveen, Netherlands; Edward J. Russell, Gladwin, Mich.

[73] Assignee: Van Dam Machine Corporation of America, West Paterson, N.J.

[21] Appl. No.: 254,807

[22] Filed: Apr. 16, 1981

[51] Int. Cl.[3] ..... B05C 11/00

[52] U.S. Cl. ..... 118/46; 101/38 A; 101/40; 118/218; 118/230; 118/233

[58] Field of Search ..... 101/38-40; 118/46, 218, 230, 232, 233

[56] References Cited

U.S. PATENT DOCUMENTS

| | | | |
|---|---|---|---|
| 3,115,091 | 12/1963 | Hakogi | 101/40 |
| 3,356,019 | 12/1967 | Zurick | 101/39 |
| 3,469,670 | 9/1969 | Cartwright | 101/40 |
| 3,851,579 | 12/1974 | Zurick | 101/39 |
| 4,037,530 | 7/1977 | Sirvet | 101/40 |
| 4,055,142 | 10/1977 | Lajovic | 101/40 X |
| 4,092,949 | 6/1978 | Balordi | 101/40 X |
| 4,140,053 | 2/1979 | Skrypek et al. | 101/40 |

*Primary Examiner*—Bernard D. Pianalto
*Attorney, Agent, or Firm*—David A. Jackson

[57] ABSTRACT

A mandrel wheel assembly is disclosed for use with an apparatus for the continuous decoration of containers such as cylindrical cans, and comprises a circular mandrel wheel having a plurality of regularly spaced mandrel assemblies mounted transversely about its circumferential periphery. The mandrel assemblies have cam roller ends that communicate with a guiding stationary box cam, and oppositely extending container receiving mandrels. The mandrel wheel assembly is mounted along a stationary central shaft. A secondary mandrel support is provided adjacent the mandrels comprising a stationary planar support member also mounted on the central shaft with one or more planar support cams that extend radially from the secondary support member and are adapted to cammingly engage the mandrel assemblies. The support cams are juxtaposed to the coating stations and reduce unwanted deflection of the mandrels during coating operations.

7 Claims, 4 Drawing Figures

MANDREL SUPPORT MEANS FOR CONTAINER DECORATING APPARATUS

BACKGROUND OF THE INVENTION

1. Field of the Invention

This invention relates to a machine for applying a finish to the exterior surfaces of containers, such as cylindrical cans, and, in particular, relates to a high speed machine capable of applying such finishes or "decorations".

2. Description of the Prior Art

In general, a variety of machines for applying decorative finishes to containers such as cans and the like are known and comprise an infeed or conveyor assembly that transports the cans initially, and a star wheel assembly, including an upper star wheel and a lower cooperating pocket wheel, that receive the cans serially within regularly spaced circumferential recesses and move the cans into position for reception upon corresponding mandrels located on a circular turret or wheel that is axially displaced from the star wheel assembly. After receiving the cans, the mandrels are moved into position for the printing operation, where a printing roller having a given indicia is brought into rotating individual contact with each of the containers, to place an outer decoration thereon. Thereafter the mandrels bearing the container are moved to a varnishing station where an outer coat of varnish is applied to finish the decoration of the container.

The mandrel assemblies of the prior art have exhibited a tendency to deflect during both the printing operation, and the varnishing operation that follows. The result of this deflection is that printing clarity is diminished, and smudging of the "decoration" may occur.

Earlier attempts to provide stability to the mandrel have comprised the reinforcement of the movable support of the mandrel within the turret or mandrel wheel.

SUMMARY OF THE INVENTION

In accordance with the present invention, a mandrel wheel assembly is disclosed for use in an apparatus for the continuous decoration of containers, which comprises a circular mandrel wheel, a plurality of regularly spaced mandrel assemblies pivotally mounted on the mandrel wheel about its circumferential periphery, the mandrel assemblies comprising a first cam roller end and a second container receiving mandrel, and a box cam disposed in parallel, spaced-apart relation behind the mandrel wheel, including a box cam track that communicates with the cam roller ends of the mandrel assemblies to guide the mandrel assemblies. The mandrel assemblies may communicate indirectly with the box cam track by means of a cam follower or the like or may ride directly within the box cam track with their cam roller ends movably disposed therein. The mandrels extend transversely away from the mandrel wheel and the box cam in parallel axial direction with respect to each other and terminate at the container receiving mandrel.

The mandrel wheel assembly includes a secondary mandrel support means disposed in nonrotatable axial alignment with the mandrel wheel and box cam. The secondary mandrel support means is spaced apart from the mandrel wheel and is adjacent the container receiving mandrels. The secondary mandrel support means comprises a planar support member nonrotatably mounted about the axis of rotation of the mandrel wheel, and at least one planar support cam rigidly mounted to the periphery of the support member and defining a camming surface radially removed from the support member which is adapted to cammingly engage the mandrel assemblies along a portion of their axial lengths adjacent the container receiving mandrels, and a plurality of secondary cam rollers annularly mounted about the mandrel assemblies adjacent the mandrels and located for registry with the camming surface of the support cam when the mandrel assemblies move therepast.

In a preferred embodiment, the support cams are located in juxtaposition to the printing and varnishing stations of the can decoration apparatus, and the camming surfaces define a concavity having an arc corresponding to the outer circumference described by the respective stations.

The employment of the mandrel wheel assembly of the present invention eliminates the need for excessive reinforcement of the structure supporting the mandrel assemblies within the mandrel wheel, while providing the necessary stability of the mandrel assemblies at the location where the coating operations are conducted. Moreover, the provision of the mandrel support means as an independent structure avoids the placement of undue stress on the remaining operating components of the mandrel wheel assembly.

Accordingly, it is a principal object of the present invention to provide an improved mandrel wheel assembly for use in an automated container decorating apparatus.

It is a further object of the present invention to provide an improved mandrel wheel assembly as aforesaid which eliminates the undesirable deflection of the mandrel during the printing and varnishing cycles.

It is a still further object of the present invention to provide a mandrel wheel assembly as aforesaid which reduces the expenses of fabrication and repair.

Other objects and advantages will become apparent to those skilled in the art from a consideration of the ensuing description which proceeds with reference to the following illustrative drawings.

DETAILED DESCRIPTION

The present invention relates to a mandrel wheel assembly useful in an apparatus for the automated decoration of containers such as cans and the like.

Figure 1:
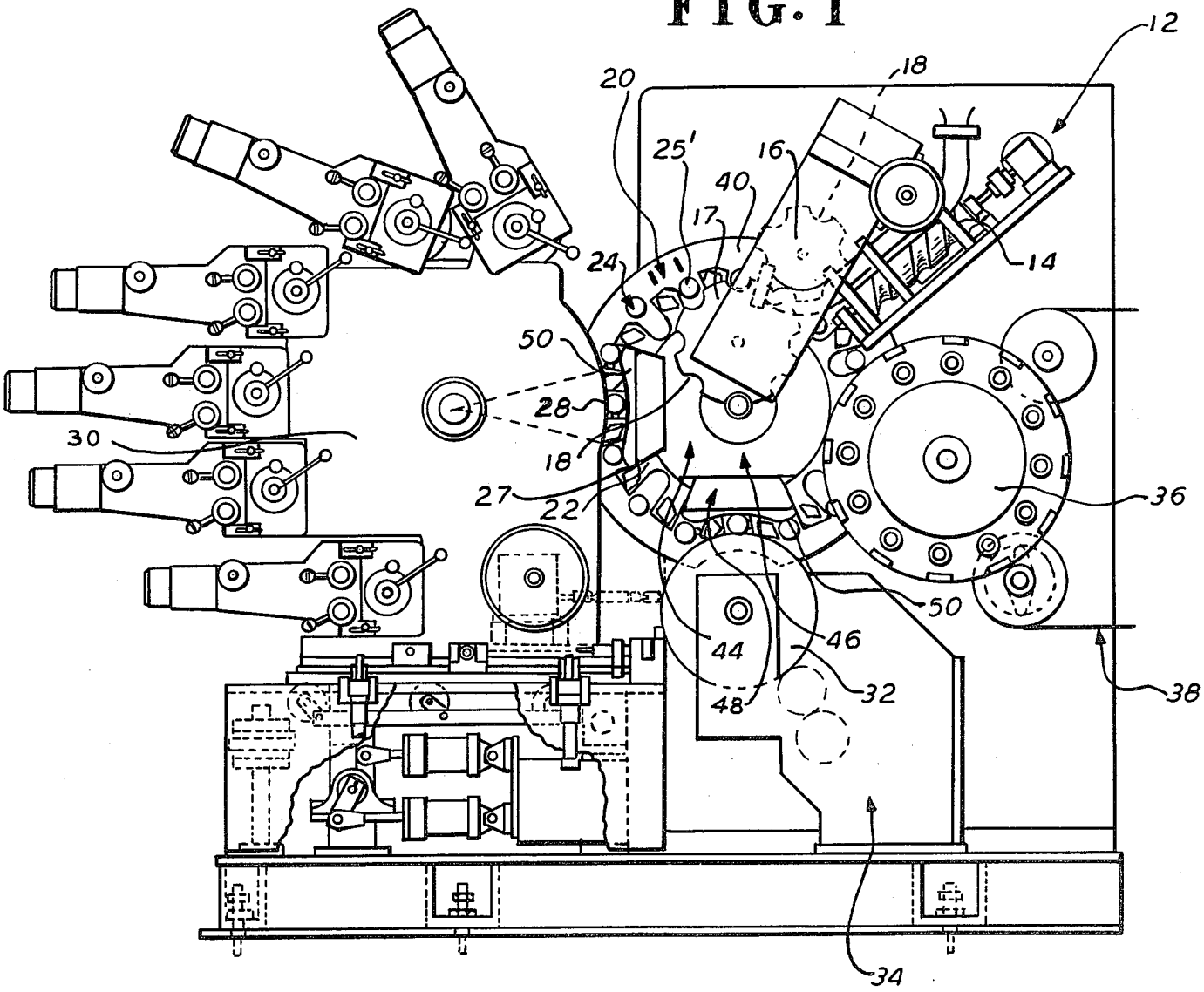
FIG. 1 is a front schematic view partly in phantom of a container decorating apparatus of the present invention.

Referring to FIG. 1, container decorating apparatus 10 as illustrated may include a conveyor assembly 12 that feeds the incoming containers in orderly fashion to the apparatus. Conveyor assembly 12 may include a feed screw 14 that transfers the incoming containers to a pair of circular members that cooperate to define a recess for their transport. Both upper star wheel 16 and lower cooperating pocket wheel 17 define a plurality of regularly spaced mating indentations or cradles 18 for the lateral reception of the containers.

Figure 3:
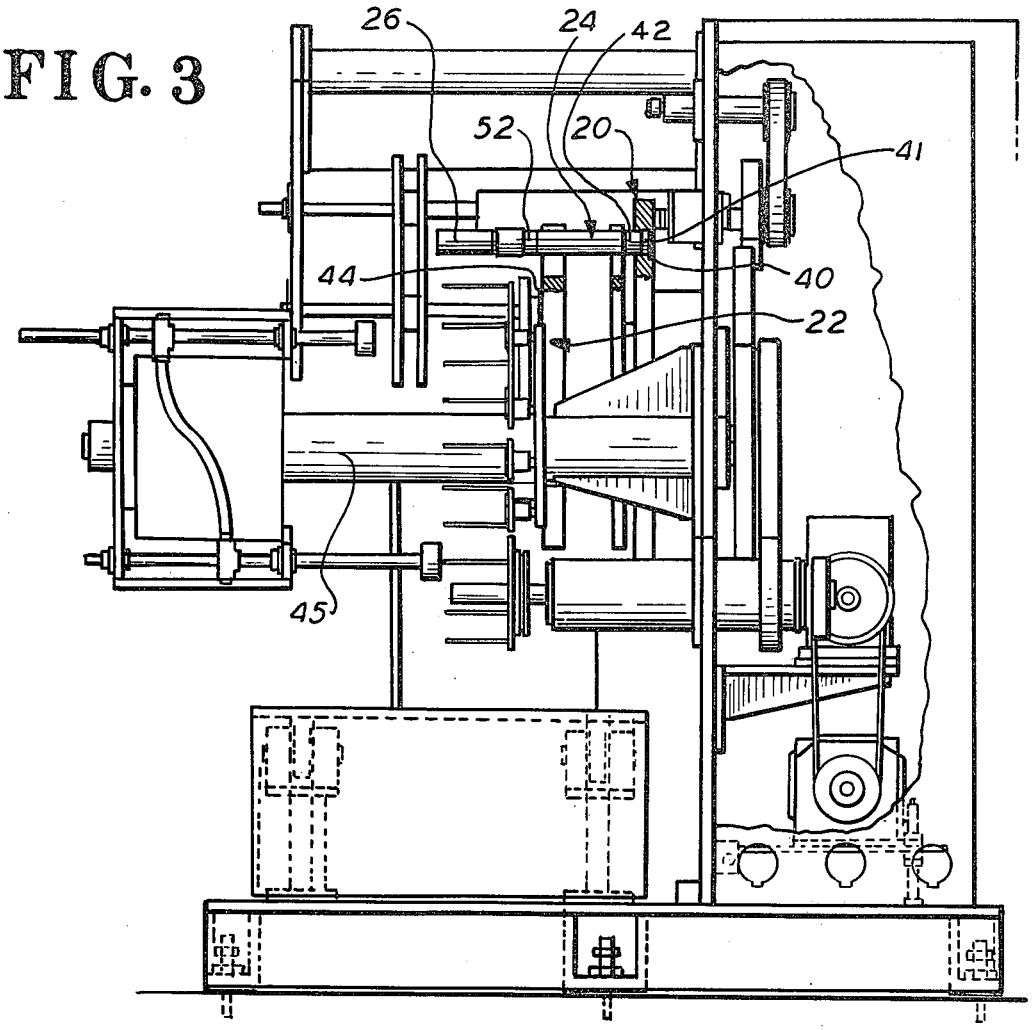
FIG. 3 is a side sectional schematic view of the present invention.

Apparatus 10 includes a mandrel wheel assembly 20 that, as illustrated, is axially adjacent to pocket wheel 17. Mandrel wheel assembly 20 comprises a mandrel wheel 22 better illustrated in FIG. 3, that defines along its circumferential periphery a plurality of regularly spaced mandrel assemblies 24. Mandrel assemblies 24 include a first cam roller end 25 and a second container receiving mandrel 25'. Mandrel assemblies 24 are pivotally supported about mandrel wheel 22 by a corresponding number of mandrel arms 27 that in turn are hingably mounted on mandrel wheel 22. The pivoting movement of mandrel arms 27 permit mandrel assemblies to track the outer circumference of the printing and varnishing stations, as described below. Mandrel assemblies 24 and mandrel wheel 22 are adapted to rotate synchronously with pocket wheel 17, so that mandrels 24 may withdraw the containers 26 from cradles 18 generally by vacuum suction means, not shown, as is conventional in the art.

Figure 2:
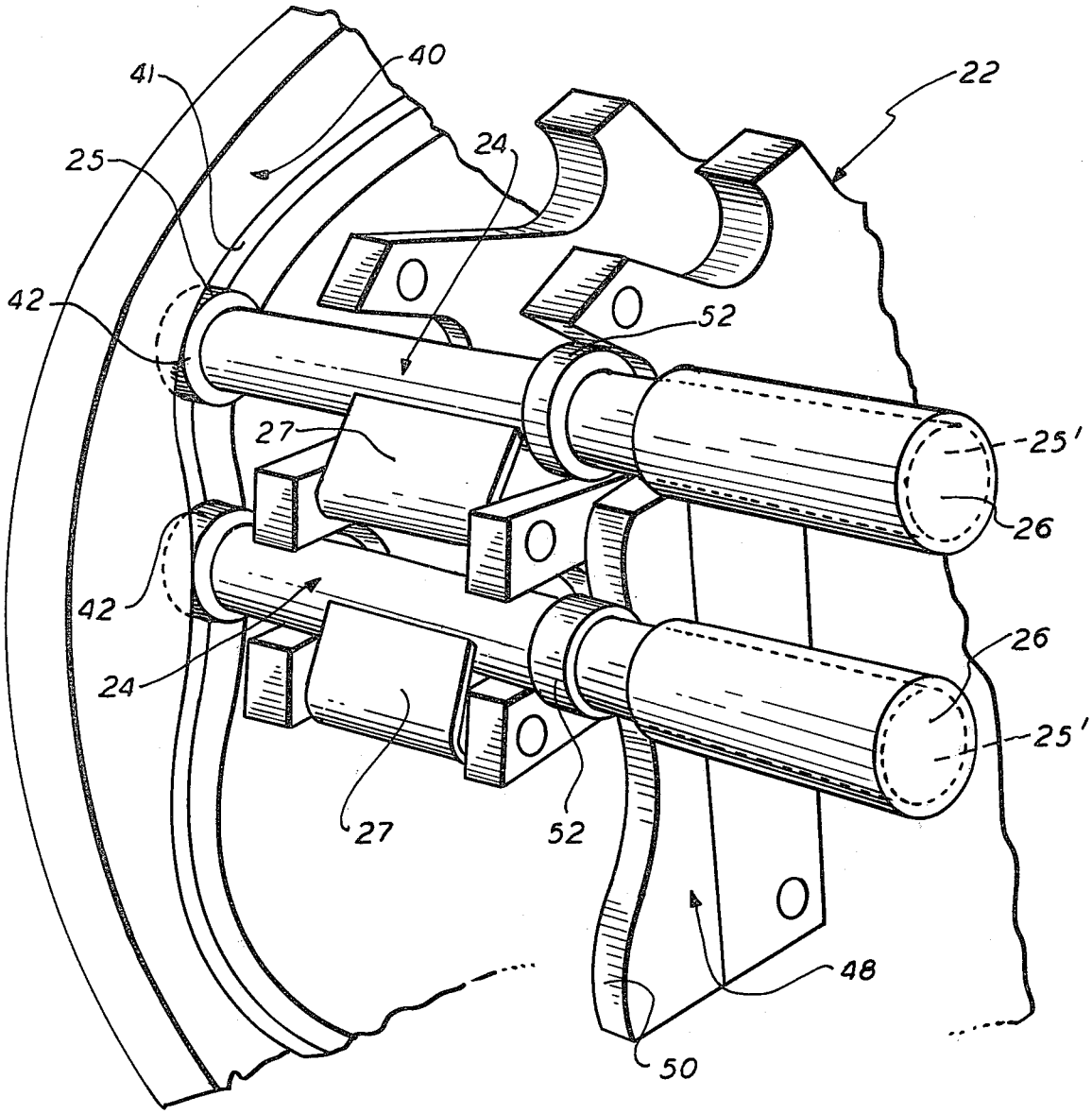
FIG. 2 is a right perspective cutaway view illustrating the mandrel wheel assembly of the present invention.

As stated earlier, the box cam track communicates with the mandrel assemblies for the purpose of guiding the path of movement of the mandrel assemblies during the rotation of the mandrel wheel. The box cam track and the mandrel assemblies may be associated by various means such as an indirect linkage, not shown, wherein a cam follower arm rides within the box cam track, and is in turn linked to the mandrel assembly. Alternately, and in accordance with the present invention, the mandrel assembly may directly communicate with the box cam track. Referring to FIG. 2, mandrel assembly 24 extends into direct engagement with box cam 40. Cam roller end 25 is disposed within box cam track 41, and travels therewithin with the assistance of cam rollers 42, mounted thereon. This direct linkage is simple in construction and reduces the number of movable parts associated with the mandrel wheel assembly.

Once disposed upon mandrels 25', containers 26 are moved into surface contact with a continuously rotating image-transfer mat or blanket designated schematically at 28, that is part of the printing press generally designated 30. Thereafter, containers 26 are moved away from blanket 28 and are brought into contact with a varnishing station comprising varnishing assembly 34, where a coating of varnish is applied by means of peripheral engagement with the surface of a varnish applicator roll 32.

After the printing and varnishing steps have been completed, containers 26 are rotated away from varnishing assembly 34 and are transferred such as by vacuum suction to a transfer wheel generally designated by numeral 36. From the transfer wheel 36, the containers 26 are transferred to juxtaposed pins, not shown, that are mounted on a chain-type output conveyor 38, that carries the containers 26 through a curing oven, not shown.

As the foregoing apparatus is a continous operation machine, each of the assemblies described above operates continuously and simultaneously with the other.

The present invention concerns the construction and operation of the mandrel wheel assembly 20, and addresses the problems that have been encountered when the containers 26 are placed in contact, first with the blanket 28 and then with the varnish application roll 32. As noted in the earlier discussion, the mandrels bearing the containers 26 were found to possess inadequate bracing or support, with the result that deflection of the mandrels occurred at the point of engagement with the respective coating stations.

The mandrel wheel assembly of the present invention, as illustrated in FIG. 1, comprises a disc-like mandrel wheel 22 having a plurality of regularly spaced mandrel assemblies 24 extending transversely along its circumference. Mandrel assemblies 24 project axially forward from the mandrel wheel 22 to define container receiving mandrels 25' that are adapted to be aligned at one point with the cradles 18 of pocket wheel 17. At alignment with cradles 18, mandrels 25' exert vacuum suction to pick up the containers 26 from cradles 18, and retain containers 26 securely thereon just prior to and throughout the various coating operations.

Mandrel wheel assembly 20 includes a secondary mandrel support means disposed adjacent to the printing and varnishing stations to assist in supporting the mandrels 25' during these coating operations. Specifically, a secondary mandrel support plate 44 is provided in nonrotatable disposition along the axis of rotation of mandrel wheel 22. As shown in FIG. 1, mandrel support plate 44 is mounted along stationary mandrel wheel shaft 45. Mandrel wheel shaft 45 extends through stationary box cam 40 and mandrel wheel 22 to provide for the attachment of support plate 44.

Figure 4:
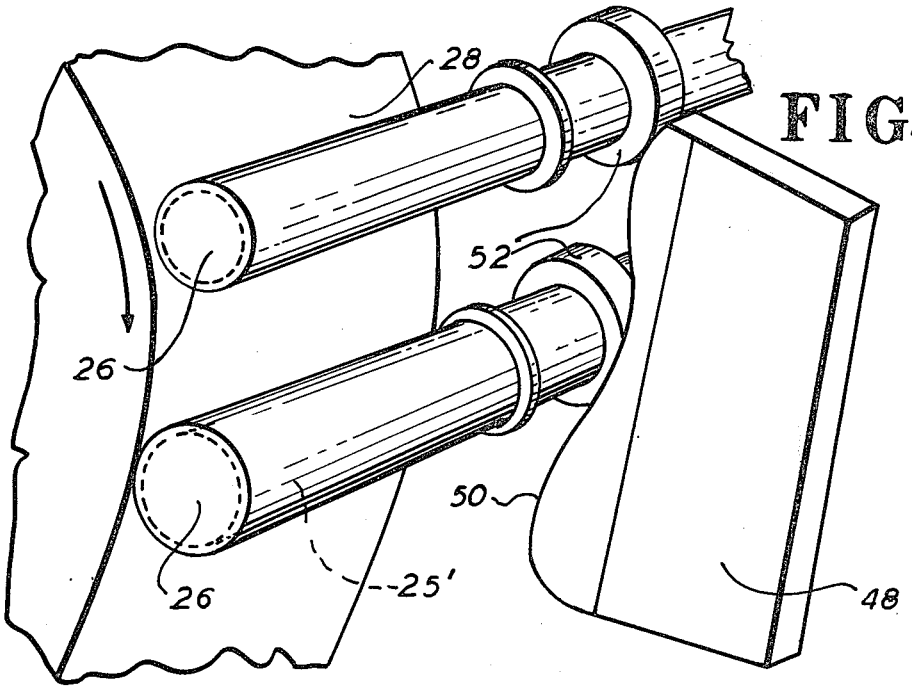
FIG. 4 is a left perspective fragmentary schematic view illustrating the mandrel wheel assembly in operation adjacent a coating station.

Support plate 44 comprises a planar member that has mounted thereon at least one, and as illustrated herein, preferably two support cams 48. Support cams 48 as shown appear essentially boat-shaped in configuration and project radially outward from support plate 44 toward mandrel assemblies 24. Support cams 48 are positioned adjacent mandrels 25', and include cam surfaces 50 which are illustrated as concave. The purpose for the concavity can be seen with reference to FIG. 1, wherein support cams 48 are juxtaposed to the respective coating stations, each of which comprise essentially cylindrical coating surfaces. Thus, and with reference to FIG. 4, when the containers 26 are brought into engagement with the respective arcuate coating surfaces, an element of radially inward movement or pressure is exerted upon the mandrel assemblies by the inward direction of box cam track 41 so that mandrel assemblies 24 move radially inward toward the center of mandrel wheel 22. The concavity of cam surfaces 50 is accordingly provided to generally correspond in arcuate shape to that of either the blanket 28 or applicator roll 32, to permit limited radial movement while providing adequate support to the mandrels 25'.

The secondary mandrel support means also includes a plurality of secondary cam rollers 52 disposed annularly about mandrel assemblies 24 adjacent mandrels 25' and positioned to lie in the same plane as the cam surface 50. In this way, cam 48 engages mandrel assemblies 24 by contact between cam surfaces 50 and the corresponding secondary cam rollers 52.

The mandrel wheel assembly of the present invention, and, in particular, the secondary mandrel support means, may be constructed from those materials well known in the art for use in such applications. Accordingly, the bearing surfaces may be prepared from those metals or nonmetallic materials that would be suitable in these applications, such materials including certain synthetic resins having suitable strength properties and the like. Naturally, the invention should not be limited to the exact choice of materials in the fabrication of particular components.

While there have been herein shown and described the preferred embodiments of the present invention, it will be understood that the invention may be embodied otherwise than as herein specifically illustrated or described, and that within such embodiment certain changes in the detail and construction, and the form and arrangement of the parts may be made without departing from the underlying idea or principles of the invention within the scope of the appending claims.

What is claimed is:

1. In an apparatus for the continuous decoration of containers, a mandrel wheel assembly comprising:

A. a substantially circular rotatable mandrel wheel,

B. a plurality of mandrel assemblies pivotally mounted on the circumferential periphery of said mandrel wheel, said mandrel assemblies extending parallel to the axis of rotation of said mandrel wheel and in the same direction with respect to each other, C. a central stationary shaft extending through said mandrel wheel at its axis of rotation, and D. a secondary mandrel support means mounted about said shaft in spaced apart relation to said mandrel wheel, said secondary mandrel support means comprising;

a. a planar support member mounted nonrotatably about said shaft, and b. at least one planar support cam extending radially from said support member, said support cam defining a camming surface radially removed from said support member, said support cam adapted to cammingly engage said mandrel assemblies along a portion of their axial lengths to support said mandrels when said mandrels are engaged in a coating operation.

2. An apparatus for the continuous decoration of containers, said apparatus comprising:

A. a conveyor assembly for receiving and serially transferring said containers,

B. a mandrel wheel assembly comprising a rotatable mandrel wheel having a circumferential periphery, including a plurality of transversely extending mandrel assemblies defining mandrels for retaining said containers, C. one or more coating stations comprising a first printing station and a second varnishing station, said coating stations disposed circumferentially adjacent said mandrel wheel assembly and radially displaced with respect to each other, and D. an output conveyor assembly disposed adjacent said mandrel wheel assembly and adapted to receive and convey said containers away from said coating stations;

E. wherein said mandrel wheel assembly comprises, a. a substantially circular mandrel wheel, b. a plurality of mandrel assemblies rotatably mounted on said mandrel wheel adjacent the circumferential periphery thereof, said mandrel assemblies extending parallel to the axis of rotation of said mandrel wheel and in the same direction with respect to each other, c. a central stationary shaft extending through said mandrel wheel at its axis of rotation, and d. a secondary mandrel support means nonrotatably mounted about said axle in spaced-apart relation to said mandrel wheel, said secondary mandrel support means comprising a planar support member mounted nonrotatably about said shaft, and at least one planar support cam extending radially from said support member, said support cam defining a camming surface adapted to engage one or more of said mandrel assemblies along a portion of their lengths when said mandrel assemblies move into position adjacent said coating stations.

3. The apparatus of claims 1 or 2 in which:

said mandrel wheel assembly includes a stationary box cam mounted in axial displacement from said mandrel wheel, said mandrel assemblies define a first cam roller end and a second container receiving mandrel, said box cam defines a box cam track communicating with the cam roller ends of said mandrel assemblies to guide the direction of movement of said mandrel assemblies during the rotation of said mandrel wheel, and said box cam track directly receives said cam roller ends.

4. The apparatus of claims 1 or 2 wherein said secondary mandrel support means includes a plurality of secondary cam rollers annularly disposed about said mandrel assemblies adjacent said mandrels, adapted to communicate with said camming surface when said mandrels are engaged in a coating operation.

5. The apparatus of claim 2 wherein said support member and said support cam are juxtaposed to said coating station.

6. The apparatus of claims 1 or 2 wherein said mandrel support means includes a plurality of secondary cam rollers disposed annularly about said mandrel assemblies and adapted to engage said planar support cam when said mandrel assemblies are adjacent thereto.

7. The apparatus of claims 1 or 2 wherein said coating stations extend arcuately and convexly in the direction of said mandrel wheel assembly, and said planar support cam includes a camming surface having a concave configuration corresponding to the configuration of the adjacent coating station.

* * * * *